United States Patent [19]

Hearn et al.

[11] Patent Number: 4,625,945

[45] Date of Patent: Dec. 2, 1986

[54] PRY BAR WEDGE MEMBER

[76] Inventors: Jay A. Hearn; John E. Hearn, both of 100 Brandy Dr., Marietta, Ohio 45750

[21] Appl. No.: 658,677

[22] Filed: Oct. 9, 1984

[51] Int. Cl.[4] ..... B25C 11/00; B66F 15/00

[52] U.S. Cl. ..... 254/25; 254/104; 254/129

[58] Field of Search ..... 254/25, 21, 129, 131, 254/104, 120; 7/166

[56] References Cited

U.S. PATENT DOCUMENTS

| | | | |
|---|---|---|---|
| D. 45,821 | 5/1914 | Shane . | |
| 96,700 | 11/1869 | Howard . | |
| 138,177 | 4/1873 | Mills . | |
| 1,395,266 | 11/1921 | Fenton | 254/25 |
| 1,486,820 | 3/1924 | Wilder | 254/25 |
| 1,492,900 | 5/1924 | Scott | 254/25 |
| 2,087,148 | 7/1937 | Hempy . | |
| 2,379,387 | 6/1945 | Tessier | 254/131 |
| 2,457,231 | 12/1948 | Henderson | 254/25 |
| 2,804,109 | 8/1957 | Fatica | 254/104 |
| 3,134,574 | 5/1964 | Reuterfors . | |
| 4,531,716 | 7/1985 | Rish | 254/21 |

*Primary Examiner*—Frederick R. Schmidt
*Assistant Examiner*—Steven P. Schad
*Attorney, Agent, or Firm*—Baldwin, Egan & Fetzer

[57] ABSTRACT

A pry bar wedge member adapted for use in the removal of forms, such as wooden forms, from poured concrete, or the like. The wedge member includes a striking surface thereon for aiding in forcing the member between the form and the poured and hardened concrete, and also includes ratchet means adapted for coaction with a breaker bar lever, for applying leverage force to the wedge member, in the operation of prying the forms loose from the poured concrete. An advantage of the pry bar wedge member is that it is useable in restricted space environments so that leverage force can be effectively applied even though the applicable space available is restricted.

11 Claims, 6 Drawing Figures

PRY BAR WEDGE MEMBER

This invention relates in general to pry bar mechanisms and more particularly to a pry bar mechanism particularly adapted for use to facilitate the removal of forms from poured concrete, or the like, and wherein the pry bar wedge member can be effectively utilized in restricted space environments.

BACKGROUND OF THE INVENTION

Pry bar mechanisms for use in tearing off forms, and for prying nails or other fasteners from wood boards and the like, are well known in the prior art. Most of such prior art pry bars comprise an elongated bar embodying a leverage portion for facilitating the prying of material from a surface. Many times the bar also includes slot means for removal of fasteners from the materials worked on, such as for instance the removal of nails from wooden forms.

One example of a prior art pry bar device is that shown in U.S. Pat. No. 3,134,574 dated May 26, 1964 in the name of A. S. E. Reuterfors and entitled Pinch Bar. While such prior art devices are usually effective in the removal or prying of forms from a surface, they are generally ineffective for use in close space environments since the elongated nature of the device generally prevents it from being effectively utilizable in many restricted space environments. Many times the space available for the use of a pry bar device in connection with removal of material from a surface is quite restricted, and this may be especially true in conjunction with removal of forms from poured concrete and the like.

Other pry bar structures are illustrated in U.S. Pat. Nos. D-45,821; 96,700; 138,148; 1,486,820 and 2,087,148.

SUMMARY OF THE INVENTION

The present invention provides a novel pry bar wedge member of compact size, adapted for use in restricted space environments, and which includes a ratchet means, for aiding in applying leverage force to the wedge member and especially in a restricted space environment.

Accordingly, an object of the invention is to provide a novel pry bar wedge member adapted for facilitating the expeditious removal of forms from poured concrete, or the like.

A still further object of the invention is to provide a pry bar wedge member of the latter type which includes ratchet means adapted for coaction with a lever or "breaker bar", for applying leverage force to the wedge member in the operation of prying forms from poured concrete in a restricted space environment.

A still further object of the invention is to provide a pry bar wedge member of the aforementioned type which includes striking surfaces thereon for facilitating the forcing of the wedge member between the forms and the poured hardened concrete, and for also applying leverage force to the forms, and which also includes slot means in the forward lip portion thereof, for facilitating the removal of fasteners, such as nails, from forms or the like.

A still further object of the invention is to provide a pry bar wedge member of the aforementioned type including a lever for reversing the direction or rotation of the ratchet means, with such lever being mounted on the forward surface of the wedge member in generally protected relation from a rearward striking surface thereon, and wherein access means is provided through the wedge member to provide for actuation of the reversing lever from the rearward end of the wedge bar.

A still further object of the invention is to provide a novel pry bar wedge member of the aforementioned type which is sturdy in construction and effective in a prying operation, and which is especially adapted for use in restricted space environments.

DESCRIPTION OF PREFERRED EMBODIMENT

Referring now again to the drawings, there is disclosed a pry bar wedge member 10 of the invention. Member 10 comprises a body portion 12 having, in the embodiment illustrated, a striking surface 14 on the rearward end thereof, adapted for being hit by a hammer, sledge, or the like, for forcing the wedge member between a form surface and the confronting solidified concrete surface, for stripping the form F (FIG. 5) from the concrete, and as will be hereinafter described in greater detail.

Figure 2:
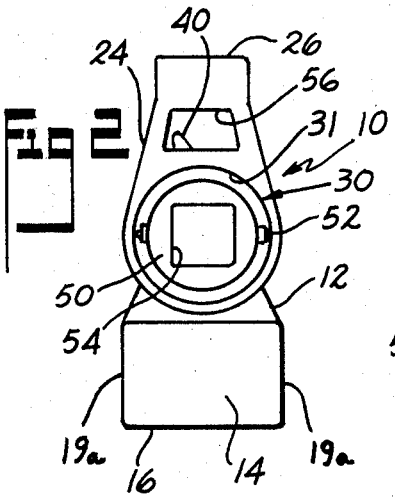
FIG. 2 is a rear end elevational view of the wedge bar member of FIG. 1, but with the breaker bar receiving socket thereon having been rotated 90 degrees.
Figure 1:
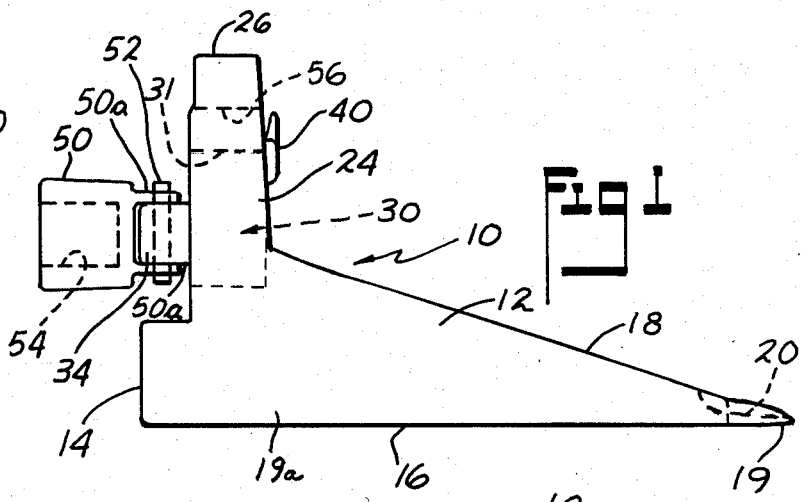
FIG. 1 is a side elevational view of a wedge bar member in accordance with the invention.
Figure 3:
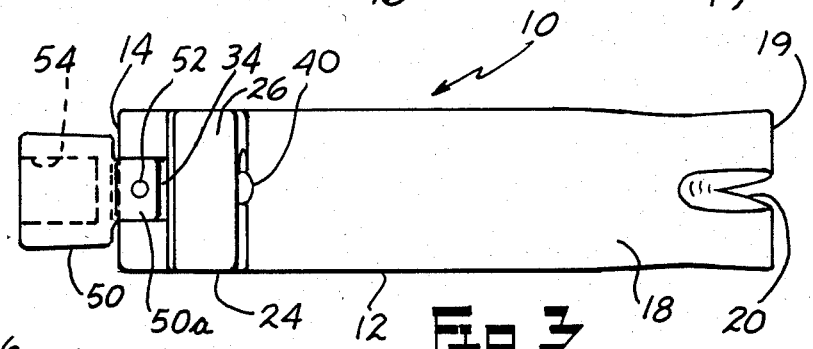
FIG. 3 is a top plan view of the wedge member of FIGS. 1 and 2.

Body 12 preferably has a flat bottom surface 16 and an upwardly and rearwardly divergent top surface 18, and generally vertical, spaced side surfaces 19*a*, as can be best seen in FIGS. 1 and 2. At its forward lipped end 19, the body portion may include a nail pulling slot 20. The frontal slot 20 is preferably tapered or cut away as at 22, so as to facilitate receiving the head of a fastener, such as a nail, into the generally V-like groove of slot 20 for facilitating removal of a headed fastener.

Wedge member 10 may also include a head portion 24 projecting upwardly from the body portion 12 as best illustrated in FIG. 1, with the head portion 24 preferably having an upper striking surface 26, adapted for impact by a hammer, or sledge, or the like, for applying an impact force to the head portion and thus providing for application of rotative leverage force about an axis passing transversely of said body portion. Side surfaces 19*a* and bottom surface 16 extend rearwardly of the head portion 24 and merge with striking surface 14. Wedge member 10 may be formed of for instance wrought iron, or steel, and while being of relatively compact size (being preferably approximately 6½ inches to 7½ inches overall length in the embodiment illustrated) it is also of a high strength nature, so as to effectively provide for wedging and prying operations. Body portion 12 preferably tapers down to a rather sharpened forward or leading end so that it can be more effectively started and forced between a form F and the poured and hardened concrete, for removal of the form.

In accordance with the invention, the wedge member 10 has a preferably high strength ratchet mechanism 30 coacting therewith, and in the embodiment illustrated received in a recess 31 formed in the head portion of the wedge member. Such ratchet mechanism, in the embodiment illustrated, may comprise a toothed rotatable disc 32 which has projecting therefrom an extension shank 34. A pivotal pawl 36 may be pivoted as at 38 as by means of lever 40, with the pawl having teeth 42, 42*a* thereon adapted for mating coaction with the teeth on the rotary disc member 32. A spring-loaded detent 44 is adapted for coaction with the cam surfaces 46, 46*a* on the pawl member 36, for urging the pawl member in a direction depending upon the position of the actuating control lever 40.

Figure 4:
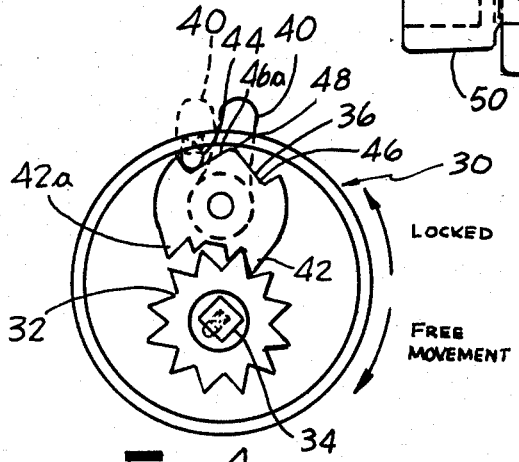
FIG. 4 is a generally diagrammatic, enlarged, elevational view of ratchet mechanism adapted for mounting in the body of the wedge member.

As illustrated in FIG. 4, when the pawl member 36 is in the position illustrated, the spring-loaded detent 44 is coacting with cam surface 46*a* and the tooth 42 on the pawl 36 is interengaged with the teeth on disc 32. In such position, the disc 32 and projecting stud 34 can be rotated in a clockwise direction, but are non-rotatable or locked in a counterclockwise direction, due to the interacting coaction between the tooth 42 on the pawl and the teeth on disc 32. Flipping the lever 40 to its other position (shown in phantom in FIG. 4) will cause the tooth 42*a* on the pawl to come into coaction (engaged relationship) with the teeth on the disc 32 and thus cause locking of the disc and projecting shank 34 in a clockwise direction. Flipping of the lever 40 will also of course cause the spring loaded detent 44 to ride up over the high point 48 on the pawl and cause it to interengage with the cam surface 46 on the other side of the pawl.

Figure 5:
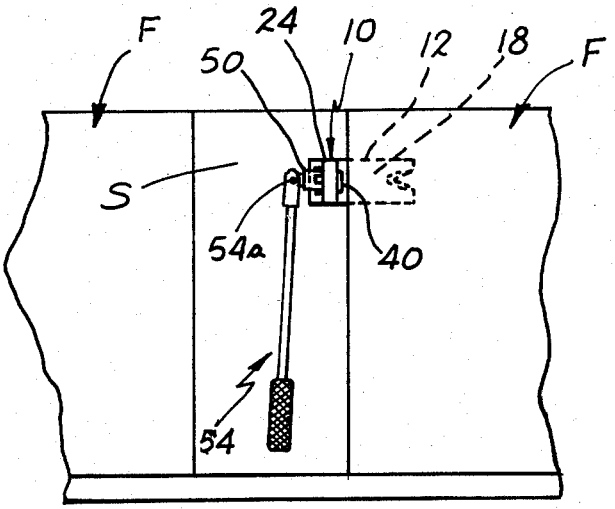
FIG. 5 is a diagrammatic illustration of the wedge member of the invention being used with a breaker bar lever in a restricted environment, for prying of a wood form from a poured concrete installation.

As can be best seen in FIG. 1, the stud 34 projects rearwardly of the head portion of the wedge, and in the embodiment illustrated, there is pivotally coupled to stud 34, a female socket member 50 which is pivotally coupled to the stud 34, by means of a preferably high strength, heavy duty shear pin 52. Thus socket 50 and its associated ears 50*a* can pivot about the axis defined by the lengthwise dimension of pin 52, for approximately 180°. Socket member 50 has a recess 54 therein of conventional size (say for instance three quarter inch drive) adapted to receive the complementary prong or shank on a conventional breaker bar 54. Such conventional breaker bar may have, for instance, a three quarter inch drive shank pivoted as at 54*a* to the bar handle, as seen in FIG. 5. Thus, the breaker bar or lever 54 applies the leverage to wedge member 10 when the actuating control lever 40 of the ratchet is in a position to prevent rotation of the ratchet in the direction that the leverage is being applied by breaker bar 54.

As can be best seen in FIG. 2, a through opening 56 may be provided in head portion 24 to obtain access to ratchet control lever 40 from the rearward side of the wedge member, with the directional lever 40 being mounted, in the embodiment illustrated, on the front side of the head portion 24.

The pry bar wedge member 10 of the invention is particularly useful in close or restricted space environments. As can be seen in FIG. 5, the wedge member 10 has been driven between a form F (e.g. wooden form) and the confronting poured and hardened concrete within a restricted space S, and the breaker bar or lever 54 coacting with the socket 50 on the ratchet, is utilized from a position laterally of the wedge member 10 to apply leverage force to the wedge member, and thereby provide for forcing or prying of the form F from the concrete surface. Since the socket 50 is pinned to the ratchet stud 34, and can be swiveled approximately 180°, the lever 54 can be readily received within the socket from a lateral position.

Figure 6:
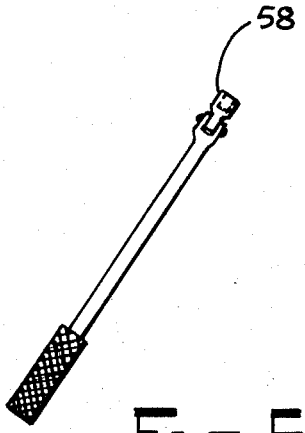
FIG. 6 is a generally diagrammatic elevational view of a modified breaker bar lever useable with the pry bar wedge member of the invention.

It will be understood that while a female socket 50 is shown attached to the stud 34 on the ratchet mechanism, such female socket member could be deleted and merely have the stud 34 available for coaction with a conventional female socket 58 pivoted to a breaker bar handle, as shown for instance in FIG. 6. Thus the wedge member itself would not embody a female socket, but instead would utilize a socket on an associated breaker bar or lever to apply leverage to the ratchet and thus to the body of the pry bar wedge member. It will be seen that the direction of rotation of the ratchet mechanism 30 can be readily accomplished from rearwardly of the wedge member, by inserting a pointed tool such as a screwdriver, or a finger, through opening 56 and flipping the lever to the other side, thus reversing the direction of rotation of the ratchet and reversing the direction of locking of the ratchet.

From the foregoing description and accompanying drawings, it will be seen that the invention provides a novel pry bar wedge member which is of high strength and compact construction, particularly adapted for facilitating removal of forms from poured concrete, or the like, and with the wedge member embodying a coacting ratchet mechanism for facilitating the application of leverage force to the wedge member in the operation of prying forms, or the like, loose from attached structure. The ratchet is reversible so as to reverse the direction that the leverage can be applied by the ratchet to the wedge body, and the wedge member is adapted for use in restricted space environments and in a manner with an associated breaker bar that enables prying or wedging operations to be expeditiously accomplished.

The terms and expressions which have been used are used as terms of description, and not of limitation, and there is no intention in the use of such terms and expressions of excluding any equivalents of any of the features shown or described, or portions thereof, and it is recognized that various modifications are possible within the scope of the invention claimed.

What is claimed is:

1. A pry bar wedge member adapted for facilitating the removal of forms from poured concrete or the like comprising, an elongated wedge shaped body portion having means thereon for forcing the body portion between a form and poured hardened concrete, a head portion adjacent the rearward end of said wedge member projecting upwardly from said body portion, said means comprising a striking surface on the rearward end of said body portion adapted for hammering for causing forced entry of said body portion between a form and poured hardened concrete, and ratchet means in said head portion adapted for coaction with a lever, for applying leverage force to the body portion in the operation of prying the forms loose from the attached structure, said ratchet means in operation being rotatable about an axis extending generally parallel to the longitudinal axis of said body portion, said ratchet means including projecting means enabling the lever to be extended from the ratchet means generally perpendicular to the rotary axis of said ratchet means whereby said leverage force can be applied to said body portion from laterally of said rotary axis of said ratchet means to cause said wedge member to rotate about said longitudinal axis of said body portion in the operation of prying a form loose from the attached structure in restricted space environments, and said ratchet means including means on said head portion on the opposite side of said head portion as compared to the side of said head portion on which is located said striking surface on said body portion, for selectively reversing the permissible direction of rotation of said ratchet means.

2. A wedge member in accordance with claim 1 wherein said body portion includes slot means in the forward end thereof adapted for facilitating the prying of fasteners, such as nails, from a form.

3. A wedge member in accordance with claim 1 wherein said projecting means of said ratchet means includes a swivel socket for coaction with an associated separable lever in the application of said leverage force to the body portion.

4. A wedge member in accordance with claim 1 wherein said body portion includes a generally flat bottom surface, a generally upwardly sloping and rearwardly diverging top surface, and said head portion adjacent the rearward end of said member projecting upwardly from said top surface of said body portion.

5. A wedge member in accordance with claim 4 including an opening means through said head portion providing access to said reversing means for activation thereof from the rearward end of said wedge member.

6. A wedge member in accordance with claim 4 wherein said body portion includes spaced generally vertical side surfaces merging with said top and bottom surfaces, said projecting means of said rachet means comprising a male stud projecting from a rotatable toothed disc of said ratchet means, said side and bottom surfaces extending rearwardly of said male stud and merging with said means for forcing the wedge between the form and the poured concrete, said head portion being disposed forwardly of and above said striking surface, the combination therewith of the associated lever coacting with said stud of said ratchet means and being actuatable from laterally of the body portion and of the longitudinal axis thereof so that the wedge member can be effectively utilized in restricted space environments.

7. A wedge member in accordance with claim 4 including a striking surface on the upper section of said head portion for applying impact force to the head portion and thus applying rotative leverage force about an axis passing transversely of said body portion forwardly of said head portion.

8. A wedge member in accordance with claim 1 wherein said body portion of the wedge member is formed of wrought iron.

9. A wedge member in accordance with claim 1 wherein said projecting means of said ratchet means includes a male projection extending from a rotatable toothed disc member of said ratchet means and rearwardly relative to said disc member, and coacting with a female socket of an associated separable lever, for actuation of said ratchet means by the lever from a direction generally perpendicular to said rotary axis of said ratchet means.

10. A wedge member in accordance with claim 1 wherein said body portion has a sharpened lip on the forward end thereof for facilitating its entry between a form and the poured concrete.

11. A pry bar wedge member and a separable associated lever adapted for facilitating the removal of forms from poured concrete or the like comprising, an elongated body portion having means thereon for forcing the wedge body portion between a form and poured hardened concrete, said body portion including a generally flat bottom surface, a generally upwardly sloping and rearwardly diverging top surface, and generally vertical side surfaces merging with said top and bottom surfaces, a head portion adjacent the rearward end of said wedge member projecting upwardly above said top surface, said side surfaces and said bottom surface extending rearwardly of said head portion and merging with means for forcing the wedge member between a form and poured hardened concrete, the last mentioned means comprising a flat striking surface on the rearward end of said body portion adapted for hammering for causing forced entry of said body portion between the form and the poured hardened concrete, ratchet means in said head portion coacting with said lever for applying leverage force to said body portion in the operation of prying a form loose from attached structure, said ratchet means including a toothed rotatable disc member rotatable about an axis extending generally parallel to the longitudinal axis of said body portion, said ratchet means including rearwardly projecting stud means attached thereto and enabling the lever to be detachably connected to and extended from the ratchet means generally perpendicular to the rotary axis of said ratchet means whereby leverage can be applied to said body portion from laterally of said rotary axis of said ratchet means, to cause the wedge member to rotate about said longitudinal axis of said body portion, thus providing for effective use of said wedge member in restricted space environments, means on the forward side of said head portion for selectively reversing the permissible direction of rotation of said ratchet means, an opening through said head portion providing access to said selective reversing means for actuation thereof from the rearward side of said head portion, said opening being disposed above said stud means, the latter extending rearwardly from said head portion, said head portion on the upper end thereof including a striking surface adapted for applying impact force to said head portion and thus providing for the application of rotative leverage force to said body portion about an axis extending transversely of said body portion forwardly of said head portion.

* * * * *